United States Patent [19]

Pfau

[11] 4,304,549

[45] Dec. 8, 1981

[54] RECUPERATOR BURNER FOR INDUSTRIAL FURNACES

[75] Inventor: Hans Pfau, Kleve, Fed. Rep. of Germany

[73] Assignee: Ipsen Industries International Gesellschaft mit beschränkter Haftung, Kleve, Fed. Rep. of Germany

[21] Appl. No.: 66,946

[22] Filed: Aug. 16, 1979

[30] Foreign Application Priority Data

Aug. 19, 1978 [DE] Fed. Rep. of Germany ..... 2836433

[51] Int. Cl.[3] ..... F23D 11/44

[52] U.S. Cl. ..... 431/215; 431/187; 431/347; 165/141; 165/DIG. 12; 239/433

[58] Field of Search ..... 431/161, 166, 187, 215, 431/347; 239/129, 132.5, 135, 424, 433; 165/140, 141, DIG. 12

[56] References Cited

U.S. PATENT DOCUMENTS 3,212,558 10/1965 Williams ..... 431/215
3,695,816 10/1972 Oeppen et al. ..... 431/215

FOREIGN PATENT DOCUMENTS 2643293 3/1978 Fed. Rep. of Germany ..... 239/424
1248912 10/1971 United Kingdom ..... 431/215

*Primary Examiner*—Samuel Scott
*Assistant Examiner*—Lee E. Barrett
*Attorney, Agent, or Firm*—Martin A. Farber

[57] ABSTRACT

Recuperator burner for industrial furnaces with a central fuel tube which leads the gaseous fuel into a combustion chamber, which tube is concentrically surrounded by a combustion-air supply tube, the outer surface area of the combustion-air supply tube in the area of the recuperator being able to be applied with the exhaust gases which are guided in counterflow through an outer jacket tube and in which combustion-air supply tube there is arranged a first tubular separation wall. The separation wall first guides the combustion-air stream on the way to the combustion chamber along the central fuel tube up to the outlet-side end range of the fuel tube and then redirecting the combustion-air stream in reversed direction. The first tubular separation wall is surrounded concentrically by a second tubular separation wall, which second tubular separation wall with the outer wall of the fuel tube forms an air-tight closure at the outlet-side end and guides the combustion-air stream back via the recuperator through the annular channel to the outlet end, the annular channel being formed with the tubular wall of the combustion-air supply tube.

7 Claims, 4 Drawing Figures

RECUPERATOR BURNER FOR INDUSTRIAL FURNACES

The invention relates to a recuperator burner for industrial furnaces according to the introductory part of claim 1.

Recuperator burners serve for the heating of industrial furnaces, radiation heater tubes or other units in which the exhaust gases before leaving the system give a part of their heat content to the oxygen carrier required for the combustion of the fuel gas, which oxygen carrier in most cases is supplied as air. By the heating of the combustion air, a part of the heat content of the exhaust gases is again supplied for the combustion. Connected with this is an increase of the efficiency, which increase leads to a conservation or saving of fuel. Simultaneously however attention must be taken that the preheating of the combustion gases, which gases as a rule comprise hydrocarbon mixtures, remains within limits, since upon exceeding of the permissible temperature the danger exists that the hydrocarbons separate, crack or hydrolyze and unbound carbon in the form of soot precipitates in the central fuel tube or in the exit discharge openings of the fuel nozzle.

From German Auslegeschrift No. 24 35 659 a recuperator burner for heating of a radiation heating tube with the introductory-named features is known, with which the supplied combustion air at first is led through the recuperator before it arrives along the fuel tube at the combustion chamber. The exit-sided end of the combustion air supply tube is closed and likewise as its outer wall is provided with holes in the area of the redirected combustion air stream, through which holes the combustion air can enter into the surrounding combustion chamber. The heat exchange between exhaust gas and combustion air which heat exchange determines the level of the efficiency consequently occurs before or in front of the area in which the combustion air flows around the central fuel tube. A cooling action on the fuel tube, which cooling action is aimed at by the aforementioned measure, thus as a consequence of the recuperative pre-heating of the fuel is held within limits.

The task of the invention is with a recuperator burner of the named type to eliminate largely in a simple manner a pre-heating of fuel so that the magnitude or degree of the efficiency is exclusively determined by the technically possible heat transmission. The fuel nozzle then on the basis of the low fuel heating can be constructed according to optimum combustion-technological basic considerations or principles.

The task in accordance with the invention is solved by the features mentioned in the characterized portion of claim 1.

In this manner both of the tubular separation walls are cooled intensively by the combustion air which is supplied and consequently the heat radiation on the fuel tube is extensively prevented. The interruption of the heat radiation additionally is aided by the use of polished non-oxidizing substances which reflect the largest part of the impinging heat radiation. The cooling effect can be increased further by additional application or mounting of appropriate cooling surfaces on the inner side of the tubular separation walls. A direct convective heat transfer of the combustion air (which is heated very highly in the recuperator) on the fuel tube is completely prevented or eliminated. Since both of the tubular separation walls extend over the entire effective recuperator surface and by their constructional formation make possible a direct right-angled or perpendicular impingement or collision of the combustion air on the lower face or front wall, this part is also cooled, which part is thermally stressed very greatly by the reflection of the flame which develops in the mixing chamber, and respectively, at the outlet opening through the mixing of fuel and combustion air. This cooling permits the fuel exit nozzle to be provided with a plurality of small fuel discharge openings, through which openings the fuel can flow-in axially as well as also radially at any arbitrary angle of choice into the combustion-air stream. The intensive mixing of both streams which is associated therewith leads to a complete combustion, without the combustion having to be performed with excess air, which excess air reduces the efficiency. By this intensive mixing it is moreover possible to perform the combustion in the mixing chamber already to such an extent that the burning mixture flows out from the discharge opening with very high speed; consequently it is in the position to suck-in or draw-off large quantities of exhaust gases and consequently intensively to set the exhaust gases in motion. Above all with installation of the recuperator burner in radiation heater tubes this leads to a very uniform distribution of heat over the entire length of the radiation heating tube.

Suitable formations of the invention are characterized in additional patent claims.

Embodiment examples of the invention are more closely explained on the basis of the enclosed drawings, in which.

Figure 1:
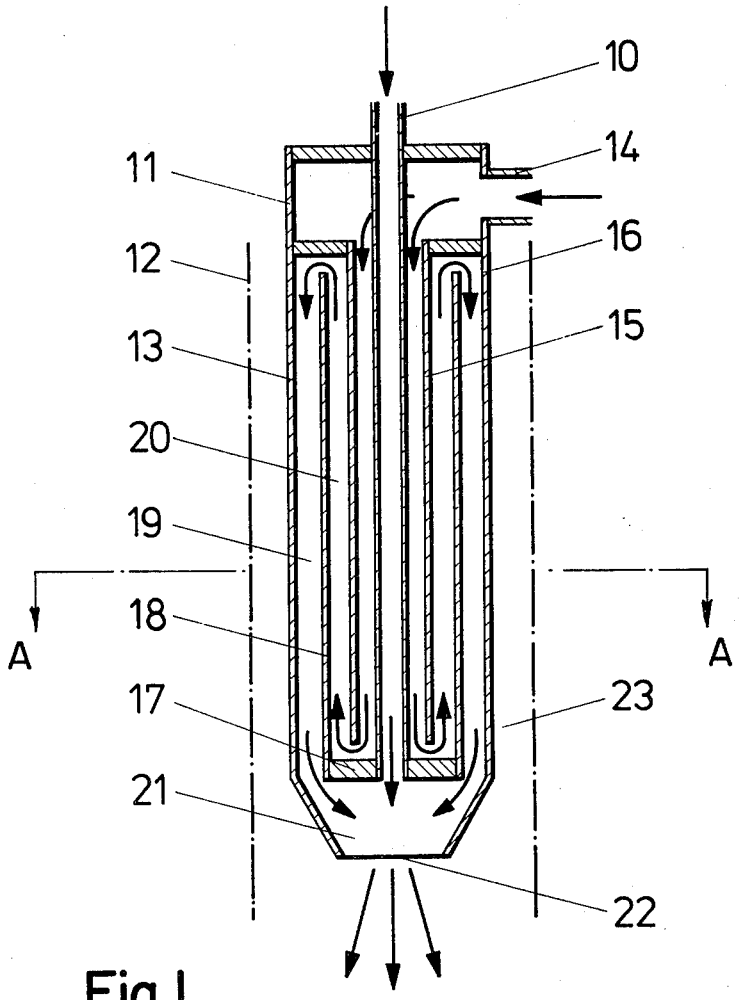
FIG. 1 is a longitudinal section through a recuperator burner according to the invention in schematic illustration.
Figure 2:
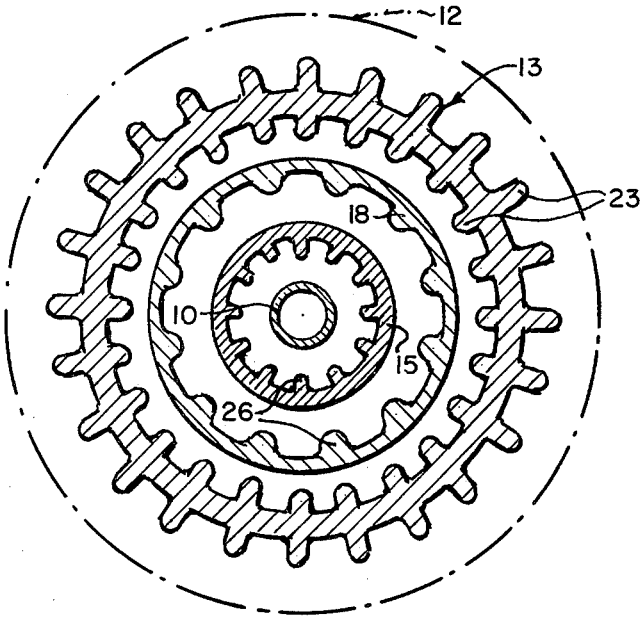
FIG. 2 is a cross-section taken along the lines A—A of FIG. 1, but showing a modified embodiment with ribs.
Figure 3:
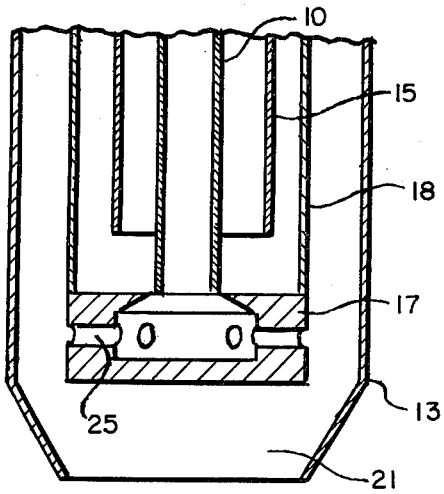
FIGS. 3 and 4 are broken away enlarged views of FIG. 1, but showing two different embodiments of gas nozzles.
Figure 4:
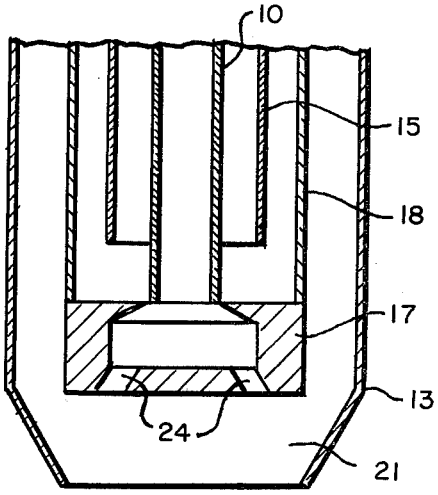

The recuperator burner which is illustrated in FIG. 1 comprises a central fuel tube 10 and a combustion-air supply tube 11 which is arranged concentrically to the tube 10, which tube 11 together with an outer jacket tube 12 forms the actual or proper recuperator 13. Inside the combustion air supply tube 11, which is connected to a non-illustrated source of combustion air by means of an inlet short feed pipe or connecting piece 14, there is arranged a first tubular separation wall 15 at a predetermined distance from the fuel tube 10, which separation wall 15 is open on the side of the air supply and is tightly connected to the tube wall 16 of the combustion-air supply tube 11. The tubular separation wall 15 ends on the exit side at a small spacing or distance from an annular-shaped face or front wall 17, the latter being tightly closed or sealed on the inside with the fuel tube 10 and on the outside with a second tubular separation wall 18, which separation wall 18 concentrically surrounds the first tubular separation wall 15 at a predetermined spacing. The annular front wall 17 however does not need to be connected in every case with the fuel tube 10 as illustrated in the illustration of FIG. 1, but can be provided as a gas nozzle with axial fuel exist openings 24 (FIG. 4) or radial fuel exit openings 25 (FIG. 5) which are arranged at any angle relative to the combustion-air flow, the number of which openings solely and entirely being determined by the fuel volume and the desired mixing. The tubular-shaped separation wall 18 forms an annular channel 19 with the tube wall 16 of the combustion-air supply tube 11, which channel 19 is in connection on the side of the air supply with the annular channel 20 (the latter being formed between the two tubular separation walls 15, 18) and discharges on the outlet side essentially at the same level with the exit or outlet of the fuel tube 10 into a mixing chamber 21, which mixing chamber 21 is formed by the projecting and somewhat drawn-in tube end of the combustion-air supply tube 11. The outlet opening 22 of the mixing chamber 21 exits into the combustion chamber which is not illustrated in more detail. Between the jacket tube 12 and the combustion-air supply tube 11 an annular channel 23 remains for the waste gases which have been led off or discharged from the combustion chamber, which annular channel 23, essentially in the region together with the combustion-air supply tube 11 forms the recuperator 13, in which recuperator inside the combustion-air supply tube 11 there is formed the annular channel 19. In a suitable manner the recuperator 13 can be provided on the side of the combustion air as well as on the side of the exhaust gas with ribs 23 for increasing its surface. The cooling effect can be increased further by additional application or mounting of appropriate cooling surfaces 26 on the inner side of the tubular separation walls.

In operation the combustion air which is supplied first cools the fuel tube 10 as well as the first tubular separation wall 15 without becoming excessively heated. With this temperature the combustion-air arrives at the lower deflection or returning place where it impinges or hits the front wall 17 at right angles or perpendicularly (which front wall 17 also can be formed as a gas nozzle). In this manner this part is particularly intensively cooled. Subsequently the combustion air arrives into the annular gap 20, and in so doing the temperature which is present or prevalent at this place also still guarantees a sufficient cooling of the second tubular separation wall 18, particularly in the lower area, which lower area is thermally stressed the most. The heating of the combustion air continues to increase thereafter and finally reaches its maximum value in the recuperator 13, before the combustion air mixes with the gaseous fuel. Measurements have shown that even under extreme thermal stresses and minimum cooling, by throttling of the combustion air supply, the fuel temperature in the gas nozzle does not exceed 300° C. Under the same conditions with recuperator burners of the customary formations, temperatures of more than 700° C. occurred at the same place.

I claim:

1. In a recuperator burner for industrial furnaces with a central fuel tube which leads the gaseous fuel from an outlet end thereof into a combustion chamber, which fuel tube is concentrically surrounded by a combustion-air supply tube forming a tube wall, the outer surface area of the combustion-air supply tube in the area of the recuperator being able to be applied by the exhaust gases which are guided in counterflow through an outer jacket tube and in which combustion-air supply tube there is arranged a first tubular separation wall, the separation wall first guiding the combustion-air stream on the way to the combustion chamber along the central fuel tube up to the vicinity of the outlet end of the fuel tube and then redirecting the combustion-air stream in reversed direction, the improvement comprising a second tubular separation wall concentrically surrounding the first tubular separation wall and forming an annular channel therebetween, said second tubular separation wall with the outside wall of the fuel tube forming an air-tight closure at the outlet end and leading the combustion-air stream back through said annular channel through the recuperator to the outlet end, said annular channel communicating with the tube wall of the combustion-air supply tube.

2. The recuperator burner according to claim 1, wherein the first and second tubular separation walls extend over the entire surface of the active recuperator and are made of polished, non-oxidizing substances with small emission rate, and additional cooling surfaces are provided on inner sides of the tubular separation walls, said inner sides face away from irradiation.

3. The recuperator burner according to claim 2, a further comprising a front wall extends between the outside wall of said fuel tube and said second tubular separation wall, the first tubular separation wall ends just short of said front wall.

4. The recuperator burner according to claim 3, wherein said front wall is formed as a gas nozzle with a plurality of fuel outlet openings, said fuel outlet openings being disposed at any angle relative to the combustion-air stream.

5. The recuperator burner according to claim 4, wherein said fuel outlet openings are axially oriented.

6. The recuperator burner according to claim 4, wherein said fuel outlet openings are radially oriented.

7. The recuperator burner according to claim 3, further comprising annular connection means for connecting the first tubular separation wall tightly to the tube wall of the combustion-air supply tube at an end remote from the outlet end, said second tubular separation wall is spaced from the tube wall of said combustion-air supply tube forming another annular channel therebetween and ends spaced from said annular connection means forming a circular flow reversal communication space between said annular channels, the combustion-air supply tube extends beyond said front wall tapering inwardly forming a mixing chamber and an exit opening of said another annular channel, communicates with the outlet end of the fuel tube.

* * * * *